US008353591B2

(12) United States Patent
Isowa et al.

(10) Patent No.: US 8,353,591 B2
(45) Date of Patent: Jan. 15, 2013

(54) APPARATUS AND METHOD FOR PRINTING CORRUGATED CARDBOARD SHEETS

(75) Inventors: Hideyuki Isowa, Kasugai (JP); Kazuhiro Hatasa, Kasugai (JP); Shunji Kato, Kasugai (JP)

(73) Assignee: Kabushiki Kaisha Isowa, Aichi (JP)

( * ) Notice: Subject to any disclaimer, the term of this patent is extended or adjusted under 35 U.S.C. 154(b) by 776 days.

(21) Appl. No.: 11/409,551

(22) Filed: Apr. 20, 2006

(65) Prior Publication Data

US 2007/0247505 A1 Oct. 25, 2007

(51) Int. Cl.
*B41J 2/01* (2006.01)

(52) U.S. Cl. ..... 347/104; 347/101; 347/34; 347/16; 347/4

(58) Field of Classification Search ..... 347/104, 347/101, 34, 4, 16
See application file for complete search history.

(56) References Cited

U.S. PATENT DOCUMENTS

| | | | | |
|---|---|---|---|---|
| 3,189,502 | A | 6/1965 | Little | |
| 3,493,122 | A | 2/1970 | McKee | |
| 3,741,117 | A | 6/1973 | Bienert et al. | |
| 4,059,220 | A | 11/1977 | Lorenz | |
| 4,339,292 | A | 7/1982 | Itoh et al. | |
| 4,792,249 | A * | 12/1988 | Lahr | 400/578 |
| 4,992,805 | A * | 2/1991 | Yoshizawa et al. | 346/134 |
| 5,037,079 | A * | 8/1991 | Siegel et al. | 271/3.22 |
| 5,428,375 | A | 6/1995 | Simon et al. | |
| 5,528,271 | A | 6/1996 | Ebisawa | |
| 5,879,000 | A * | 3/1999 | Kakuta | 271/3.02 |
| 5,906,156 | A | 5/1999 | Shibuya et al. | |
| 5,966,203 | A * | 10/1999 | Bowen | 355/73 |
| 5,992,994 | A | 11/1999 | Rasmussen et al. | |
| 6,079,617 | A | 6/2000 | Kim | |
| 6,467,410 | B1 * | 10/2002 | Rasmussen et al. | 101/424.1 |
| 6,563,527 | B1 | 5/2003 | Shimoda et al. | |
| 2002/0018097 | A1 * | 2/2002 | Kitahara et al. | 347/42 |
| 2002/0062750 | A1 | 5/2002 | Wotton et al. | |
| 2002/0113981 | A1 | 8/2002 | Nakajima | |

(Continued)

FOREIGN PATENT DOCUMENTS

CN 1586882 A 3/2005

(Continued)

OTHER PUBLICATIONS

International Search Report from EPO application No. 07106574.2 dated May 8, 2008 (6 pages).

(Continued)

*Primary Examiner* — Matthew Luu
*Assistant Examiner* — Henok Legesse
(74) *Attorney, Agent, or Firm* — Brinks Hofer Gilson & Lione

(57) ABSTRACT

A printer using ink jet printing technology to print one or more colors on a sheet for use in a box is described. The printer has a feeder, a transport mechanism for moving the sheet the print head, and a stacker to receive the printed sheet. Differential air pressure is applied by a suction box disposed in proximity to a conveyer belt for transporting the sheet. The suction box may sized so that the sheet may be oriented with a long dimension in the direction of feeding. Where multiple print heads are used, the print heads overlap in the direction transverse to the motion of the sheet so that an image larger than a print head may be produced. Two printing mechanisms disposed opposite each other may be used to print two sides of a sheet.

4 Claims, 10 Drawing Sheets

U.S. PATENT DOCUMENTS

| | | | | |
|---|---|---|---|---|
| 2002/0167578 | A1 | 11/2002 | Miki et al. | |
| 2003/0016269 | A1 | 1/2003 | Sekiya | |
| 2003/0105665 | A1 | 6/2003 | Jankovic | |
| 2004/0017456 | A1 | 1/2004 | Obertegger et al. | |
| 2004/0066441 | A1 * | 4/2004 | Jones et al. | 347/101 |
| 2004/0182503 | A1 | 9/2004 | Stadele | |
| 2006/0284953 | A1 | 12/2006 | Hatasa et al. | |

FOREIGN PATENT DOCUMENTS

| | | | |
|---|---|---|---|
| DE | 44 25 199 | A1 | 1/1996 |
| DE | 10 2004 029 037 | A1 | 12/2005 |
| EP | 0 554 989 | A1 | 8/1993 |
| EP | 1 459 878 | A2 | 3/2004 |
| EP | 1 445 112 | A | 8/2004 |
| EP | 1 449 669 | A1 | 8/2004 |
| EP | 1 731 318 | A2 | 12/2006 |
| GB | 2 343 415 | A | 5/2000 |
| JP | 07-025007 | | 1/1995 |
| JP | 07-068758 | | 3/1995 |
| JP | 2003231244 | | 8/2003 |
| JP | 2005-074763 | | 3/2005 |

OTHER PUBLICATIONS

Extended European Search Report from EPO application No. 07106579.1-2308 dated Jun. 5, 2007 (6 pages).

European Search Report dated Sep. 6, 2006.

European Search Report dated Nov. 28, 2006.

Dec. 26, 2007 Non-Final Office Action, U.S. Appl. No. 11/447,798 (8 pages).

Response to Dec. 26, 2007 Non-Final Office Action, U.S. Appl. No. 11/447,798 filed in the PTO on Jun. 18, 2008 (7 pages).

Oct. 1, 2008 Non-Final Office Action, U.S. Appl. No. 11/448,508 (16 pages).

Response to Oct. 1, 2008 Non-Final Office Action U.S. Appl. No. 11/448,508 filed in the PTO on Mar. 25, 2009 (4 pages).

Oct. 14, 2008 Non-Final Office Action, U.S. Appl. No. 11/447,798 (7 pages).

Response to Oct. 14, 2008 Non-Final Office Action, U.S. Appl. No. 11/447,798 filed in the PTO on Mar. 25, 2009 (3 pages).

Supplemental Response to Oct. 14, 2008 Non-Final Office Action, U.S. Appl. No. 11/447,798 filed in the PTO on Apr. 8, 2009 (4 pages).

Jun. 30, 2009 Non-Final Office Action, U.S. Appl. No. 11/448,508 (8 pages).

Sep. 22, 2009 Non-Final Office Action, U.S. Appl. No. 11/787,628 (20 pages).

Text of the Sixth Official Action dated Apr. 29, 2011 from the Patent Office of People's Republic of China for Chinese Patent Application No. 2007100978353 (English and Chinese), 6 pages.

* cited by examiner

APPARATUS AND METHOD FOR PRINTING CORRUGATED CARDBOARD SHEETS

TECHNICAL FIELD

This application relates to an apparatus and method of printing on corrugated cardboard sheets, and in particular to the printing of corrugated cardboard sheets for corrugated boxes, one-by-one.

BACKGROUND

Where corrugated cardboard sheets for corrugated boxes are printed one-by-one, an area of the corrugated cardboard sheet to be printed is a portion of the surface of the corrugated cardboard sheet corresponding to four face sides of the box to be formed from the sheet. On the planar cardboard sheet to be printed, the four face sides have an overall rectangular shape.

As shown in an elevation view in FIG. 1, a printer system 1 for a corrugated cardboard sheet 5, includes a feeder 10 having a kicker 11 for feeding the sheets 5, one or more printer stages 20, a creaser or slitter 30, a slotter 40, and a stacker (not shown), disposed in sequence along the direction of travel of the sheet 5 to be printed. The direction of travel of the cardboard sheet from the feeder 10 through the remainder of the printer system 1 is from right to left as shown by the broad arrow. Each of the printer stages includes a pair of rollers, 22*a* and 22*b*, where one of the rollers 22*b* has a printing die 23 (shown in FIG. 2) on the peripheral surface thereof. The second of the rollers 22*a* acts as a pressure roller in the printing process. The corrugated cardboard sheet 5, shown in plan view, is passed between the rollers 22*a* and 22*b* of each of the stages of the printer, where the rollers 22*a* and 22*b* are sized and dimensioned so that a predetermined nip pressure causes the corrugated cardboard sheet 5 sheet to be propelled in the direction of feed. At the time of passage between the rollers 22*a* and 22*b*, one surface of the corrugated cardboard sheet 5 is printed by contacting the corrugated cardboard sheet 5 with the printing die 23. Thus the pair of rollers 22*a* and 22*b* serve both to transport the sheet from stage-to-stage of the printer 1 and to print the image on the sheet with the printing die 23 affixed to the periphery of the roller 22*b*.

Each of the colors which may be required in the printing process is applied by a separate printer stage 20, the printer stages being disposed along the direction of feed of the sheet 5. Examples of printing on the sheet 5 are shown in FIG. 1, each example representing the state of the sheet 5 after completion of the printing process represented by the stage 20 of the printer 1 disposed adjacent thereto.

FIG. 2*a* shows the relationship of a corrugated cardboard sheet 5 (or "sheet") to the printing cylinder of a stage 20 of the printer 1. A printing area 6, shown as a lined region of the sheet 5, represents that area of the surface of the sheet 5 where printing may be performed. The width of the area to be printed corresponds to the width W of the printing die 23. The longer dimension X of the sheet 5 may be termed the "longitudinal" dimension, and the shorter dimension Y of the sheet 5 may be termed the "transverse" dimension. In the example of FIG. 1, the sheet is being fed through the printer 1 in the transverse direction; that is, the transverse dimension of the sheet is oriented in the direction of travel of the sheet 5 through the printer 1. An edge of the sheet 5 is also shown where the corrugations may be seen to have an approximately sinusoidal shape having an upper and lower surface adhered thereto.

As shown, the direction of corrugation is along the transverse direction of the sheet 5, such that the sinusoidal form extends in the longitudinal direction.

The length of the print area 6 determines the circumferential length of the print die 23 on the periphery of the printing cylinder 22*b*. The linear length along the direction of travel of the sheet 5 which can be printed by the printing die 23 depends on the diameter D of the cylinder 22*b* and the angular extent θ of the periphery occupied by the printing die 23. For a fixed angular extent θ, the diameter D of the print cylinder 22*b* depends linearly on the longitudinal dimension X of the sheet 5. As the size of the sheet 5 increases, the diameter of the printing cylinder 22*b* increases accordingly, and the overall dimensions of the printer 1 may be come quite large, and is determined by the longitudinal dimension of the largest sheet that the printer is intended to accommodate.

The corrugated cardboard sheet 5 may also be fed so that the longitudinal dimension X is perpendicular to the direction of feed, as shown in FIG. 1. This arrangement results in increasing the width of the printer 1 in accordance with the maximum longitudinal dimension X of sheets 5 to be accommodated by the printer 1. FIG. 1 shows a situation where an area on the corrugated cardboard sheet 5, corresponding to a faces of the completed box 50, are separately printed with a different color, and the color is represented by a differing symbol (circle, triangle, square and star). Of course each of the faces may be printed with all of the colors and the example is merely for clarity. However, particularly in the situation which obtains when there is a face on which not all of the colors are printed on each box face portion of the corrugated cardboard sheet 5, the orientation of the corrugated cardboard sheet 5 with respect to the direction of feed may be altered, resulting in a lack of registration of the images or colors.

BRIEF SUMMARY

A printer is described, including a conveyer belt having a plurality of apertures extending between a first side and a second side thereof and a suction unit for sucking a corrugated sheet to be printed toward the first side of the conveyor belt. The conveyer belt is an endless belt, engaged with pulleys separated from each other along the direction of motion, and the suction unit includes a suction box communicating with the apertures of the conveyer belt through a plurality of perforated holes. A plurality of ink jet is nozzles disposed transverse to the direction of motion of the conveyer belt, and the ink jet nozzles spaced apart from the surface of the corrugated sheet.

In another aspect, a printer includes a means for feeding a sheet to be printed and a plurality of ink jet nozzles disposed transverse to the direction in which the sheets are fed. The ink jet nozzles are spaced apart from the surface of the sheets to be printed at a predetermined distance, and dots are formed on the surface of the sheet by ink droplets jetted out from the plurality of ink jet nozzles toward the surface of the sheet. The means for feeding a sheet includes a pair of pulleys separated from each other in the feeding direction, and an endless conveyor belt including a plurality of perforated holes on the surface thereof, the endless belt movable by the pair of pulleys. A suction unit sucks the sheet toward the surface of the conveyor belt through the plurality of perforated holes. The suction unit includes a suction box vented through the plurality of perforated holes, a means for sucking air from the suction box, and a pair of baffle plates in the suction box for adjusting a suction area in the suction box. The width of the suction area is approximately equal to a width of a printing area on the sheet, where the width is measured substantially perpendicular to the feeding direction.

In yet another aspect, a printer includes a conveyer belt having a porosity to air; a suction box, disposed opposite a first surface of the conveyer belt; and a ink jet print head disposed facing a second surface of the conveyer belt. The suction box has a pair of baffles spacable apart so that a suction area is formed beneath approximately the width of a print area.

In a further aspect, a printer includes a first printing mechanism, and a second printing mechanism, where the first and second printing mechanisms are sequentially disposed along a path of a sheet to be printed. Each of the first and the second printing mechanisms includes a conveyer belt having a porosity to air; a suction box, disposed opposite a first surface of the conveyer belt; and a print head disposed facing a second surface of the conveyer belt.

The print head of the first printing mechanism is disposed opposite a first side of the sheet to be printed, and the print head of the second printing mechanism is disposed opposite a second side of the sheet to be printed. 28. A dryer is disposed between the print head of the first printing mechanism and the second printing mechanism.

In a further aspect a printer includes a first conveyer belt and a second conveyer belt, sequentially disposed along a path of a sheet to be printed; a first suction box and a second suction box, disposed opposite a first surface of the first conveyer belt and a first surface of the second conveyer belt, respectively. An upper print head is disposed so as to eject ink in a downward direction towards an upper surface of the sheet to be printed; and, a lower print head disposed so as to eject ink in an upward direction towards a lower surface of the sheet to be printed. A dryer is disposed between one of the upper print head or the lower print head and the second conveyer belt.

In still another aspect, a printer includes a means for conveying a sheet to be printed, and a plurality of ink jet nozzles disposed transverse to a direction of motion of the sheet, the ink jet nozzles spaced apart from a surface of the sheet to be printed. A first plurality of ink jet nozzles is disposed opposing a second plurality of ink jet nozzles such that the sheet to be printed is conveyed therebetween by the means for conveying.

A method of printing on a surface of an individual sheet is described, the method including the steps of: providing a conveyer belt with a suction box disposed facing a first surface thereof; providing an ink jet print head disposed such that the ink jet nozzles are in a line perpendicular to the direction of motion of the conveyer belt; disposing the ink jet print head facing a second surface of the conveyer belt; sensing the position of a first edge of the sheet; and controlling the ink jet print head to deposit ink to form an image in accordance with image data received by a controller.

BRIEF DESCRIPTION OF THE DRAWINGS

Exemplary embodiments may be better understood with reference to the drawings, but these embodiments are not intended to be of a limiting nature. Like numbered elements in the same or different drawings perform equivalent functions.

As used herein, a corrugated sheet is intended to mean any structure having at least a liner and a corrugated structure, the liner and the corrugated structure being integral or cojoined by a fixation means such as an adhesive an interlayer or the like. Such corrugated sheets are commonly made from cellulose-based materials, but as used herein the term is not intended to exclude other materials such as plastics, staple fibers, or other combinations of materials that may be formed into sheets. A corrugated structure has a minimum of a liner and a corrugated structure, but may include multiple layers of each type and with various means of joining the layers together.

A sheet may be a corrugated sheet, a flat sheet, a flat sheet with a corrugated sheet affixed to one surface, a corrugated sheet having flat sheets affixed to opposing surfaces thereof, on combinations of such arrangements. The corrugations may be sinusoidal, crenellated, triangular or the like. The sheet may be cellulose-based, plastic, fibrous or the like and may be a combination of a variety of materials such that a surface suitable for printing is formed.

An image may include a picture, a drawing, a geometric or abstract design, including text, and be of one or more colors. More than one image may be combined for printing on a surface or a face of the box or container.

In an ink-jet printing technology, a sheet 5 is printed in a non-contact manner such that an ink droplet is jetted out from an ink jet nozzle towards the surface of the sheet 5 to land at a certain position and thus forms a dot on the surface thereof. By controlling the formation of dots and the color of the dots, an image may be formed on the surface. As there is no contact between the print mechanism and the sheet 5 being printed, the deviation of the sheet 5 from alignment with respect to the direction of travel due to contact pressure differentials with a printing cylinder is avoided. Ink jet nozzles are arranged across the width of the sheet 5, corresponding to areas to be printed. Generally a plurality of nozzles are used and disposed so as to provide piecewise coverage of the printing area.

Figure 1:
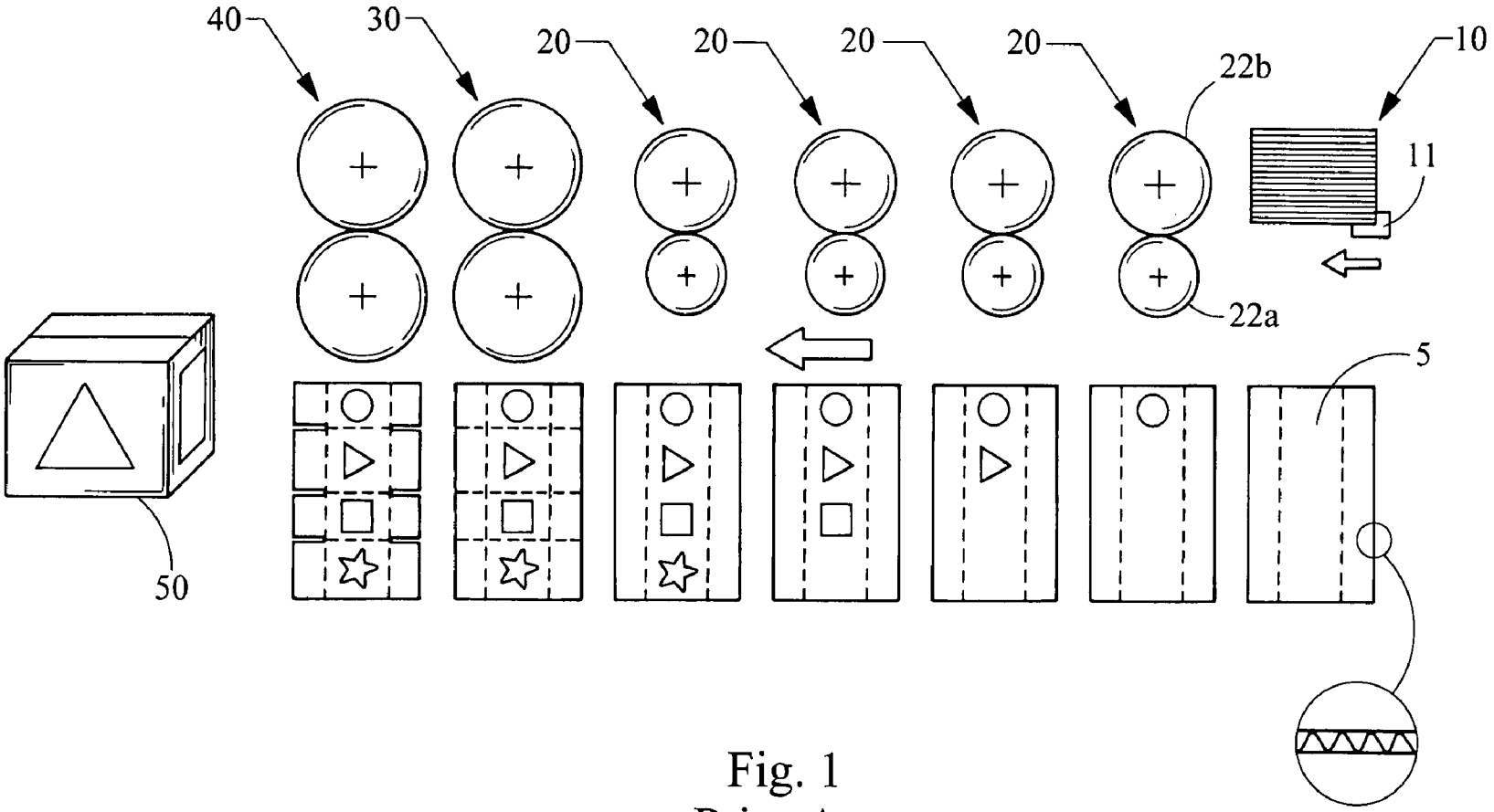
Fig. 1 Prior Art
FIG. 1 shows an example of a prior art printing process using multiple print rollers.
Figure 2A:
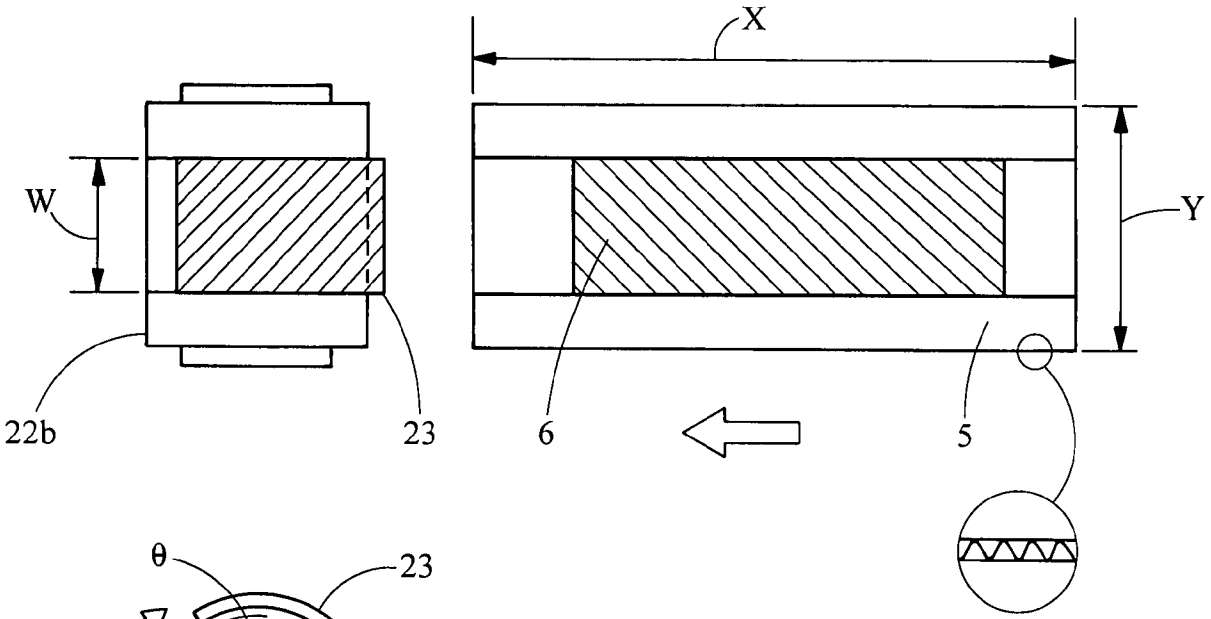
FIG. 2 illustrates the relationship of the dimensions of a printing plate in prior art printing process of FIG. 1 to the area on a cardboard sheet to be printed.
Figure 2B:
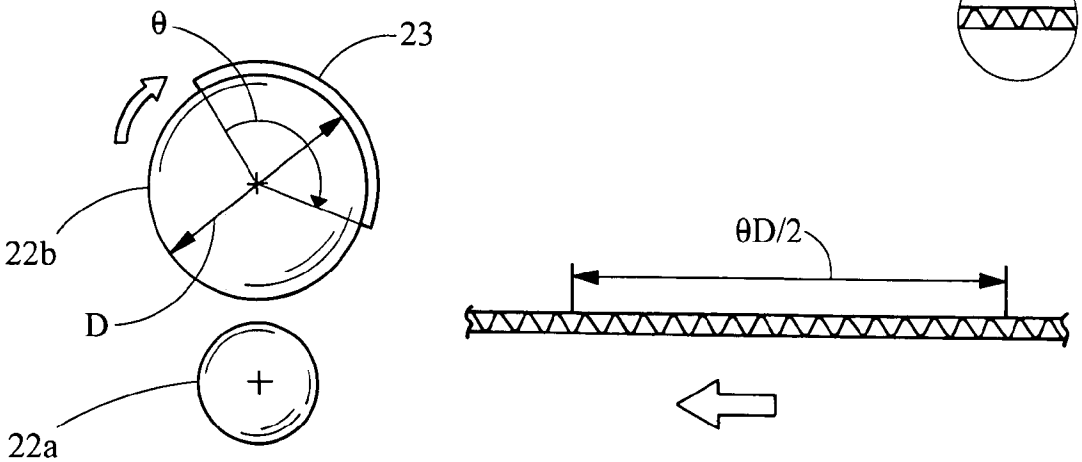
Figure 3:
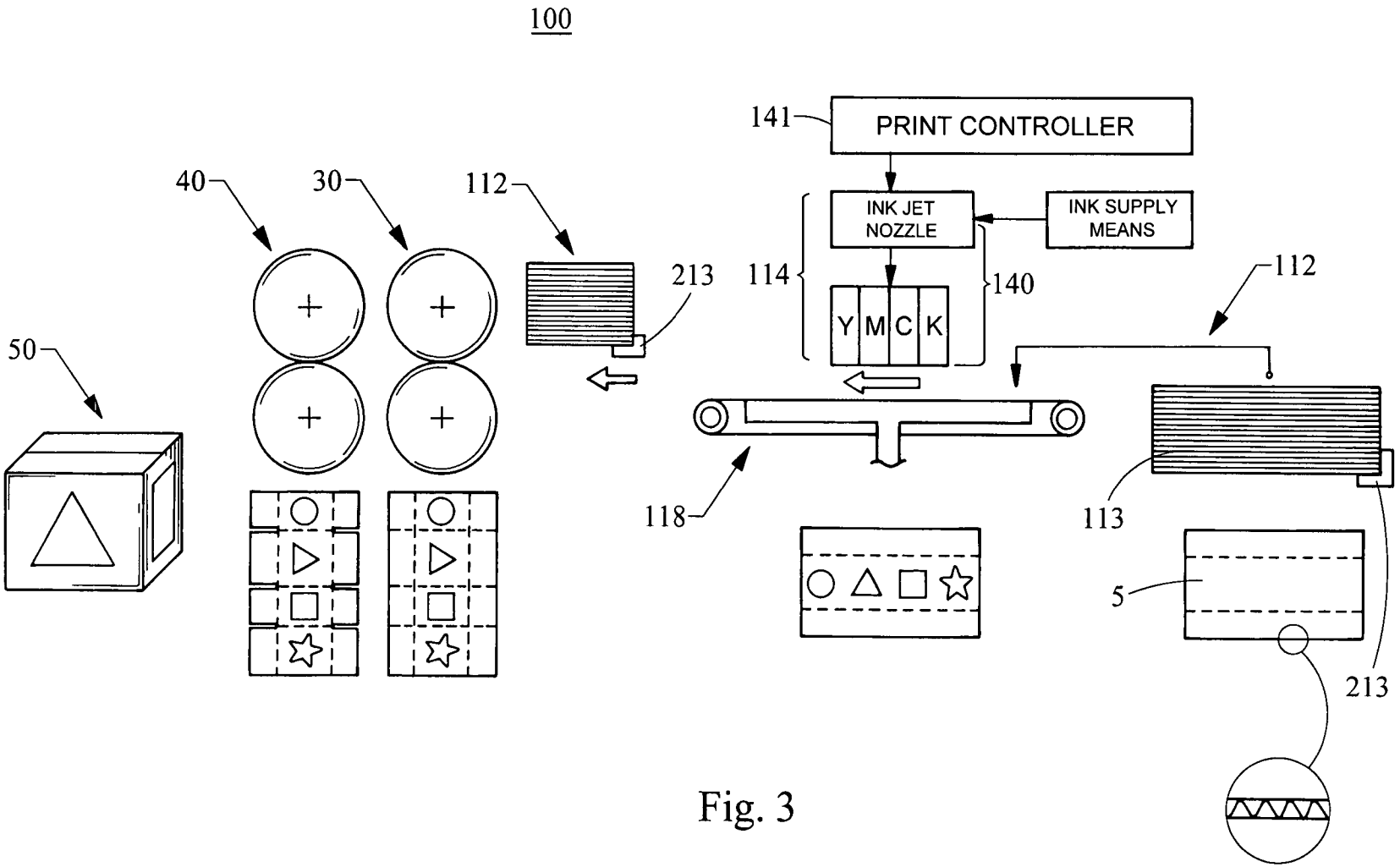
FIG. 3 illustrates a printer having ink jet printing heads.

FIG. 3 is a simplified diagram of an ink-jet printing system 100, including a feeder 112 having a kicker 213 for feeding corrugated sheets 5 from a stack of sheets 113, one-by-one, a printing unit 114 for printing a surface of the sheet 5. The sheets output from the printing area may be stacked by a stacker (not shown) and then further processed using another feeder 112, having a kicker 213, and a scorer 30 and a slotter 40, so as to prepare the sheet 5 to be formed into a box 50. The sheets 5 may be stored after the creasing and slotting process and formed into boxes 50 later, and in a different location.

A transporting unit 118 receives the a sheet 5 from the feeder 112 and moves the sheet 5 at a uniform velocity v beneath the ink jet printing unit 114, which may have a plurality of nozzles (not shown) arranged so as to dispense ink of one or more colors. A print controller 141 accepts image data from a server, communications system or the like and converts the image data into a format compatible with the printer 100. This may include converting from a red (R), green (G), blue (B) color format typical of video displays to the YMCK format. The print controller may be a microprocessor, computer, state machine or similar device having appropriate electrical interface and associated memory, which may be volatile or non-volatile memory as is known in the art. Image data may be considered to represent any type of printed image, including text, graphics, photographs, computer generated art, or the like, and combinations thereof, which may be represented by a pattern of ink dots on a surface.

The print controller 141 and any other controller, server, user or client interface described herein, or the like, interprets instructions embodied in machine readable computer code as is known in the art. Instructions for implementing processes of print controller 141 or other computing device, the processes of a client application, the processes of a server, and/or the processes of a compiler program are provided on computer-readable storage media or memories, such as a cache, buffer, RAM, removable media, hard drive or other computer readable storage media. Computer readable storage media include various types of volatile and nonvolatile storage media. The functions, acts or tasks illustrated in the figures or described herein are executed in response to one or more sets of instructions stored in or on computer readable storage media. The functions, acts or tasks are independent of the particular type of instruction set, storage media, processor or processing strategy and may be performed by software, hardware, integrated circuits, firmware, micro code and the like, operating alone or in combination. Likewise, processing strategies may include multiprocessing, multitasking, parallel processing and the like. In an embodiment, the instructions may be stored on a removable media device for reading by local or remote systems. In other embodiments, the instructions may stored in a remote location for transfer through a computer network, a local or wide area network, a wireless network, or over telephone lines. In yet other embodiments, the instructions are stored within a given computer or system.

Furthermore, as is known in the art, actions performed by a computer may equally be performed by programmable logic, and by other means including analog circuitry and mechanical analogs of these devices.

Figure 4:
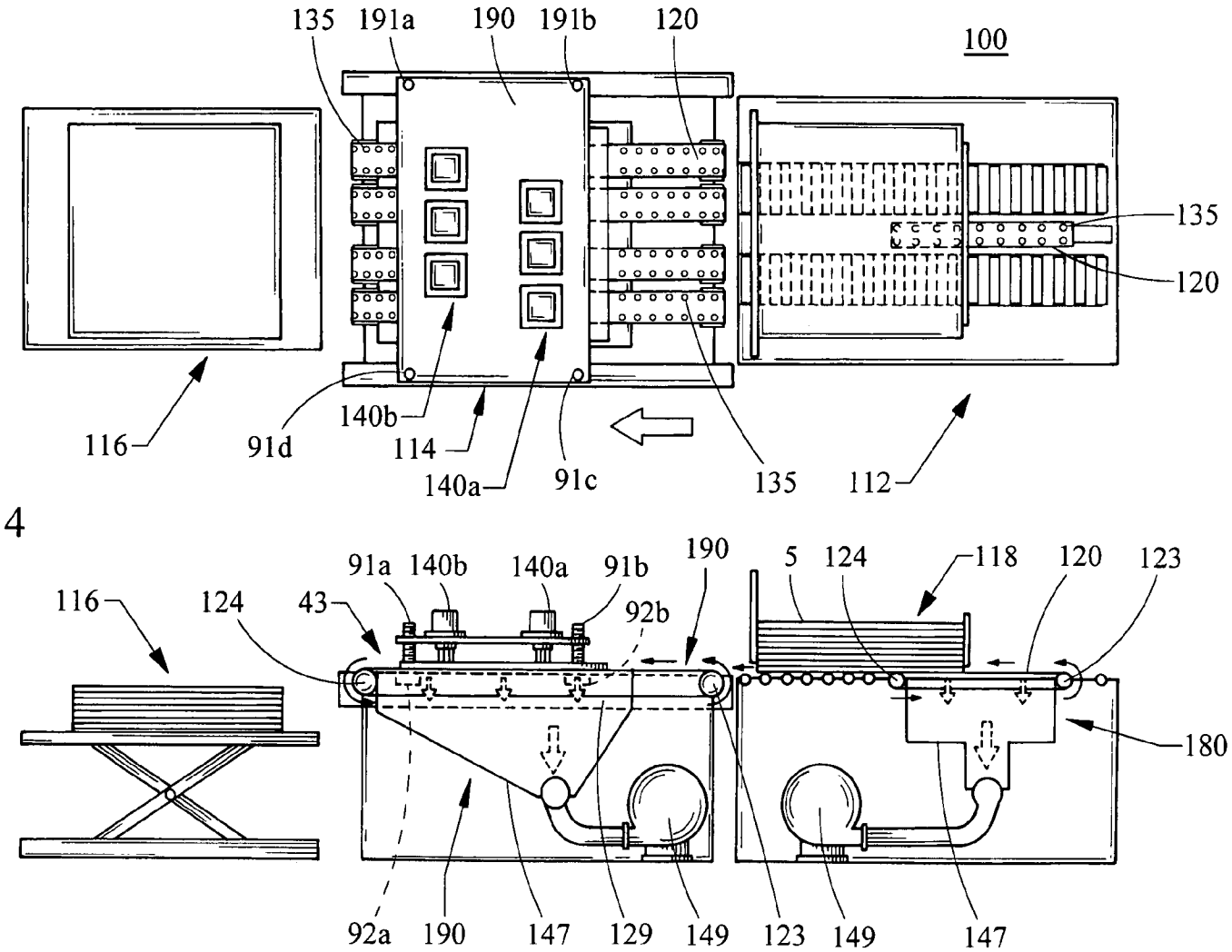
FIG. 4 illustrates a plan top view and an elevation cross-section elevation view of the transport mechanism of the printer illustrated in FIG. 3.

FIG. 4 is a more detailed example of an ink-jet printer 100. A feeder 112, a printing area 114, and a stacker 116 for stacking the printed sheets 5 are shown arranged in the direction of feeding of the sheets, The feeder 112 includes a hopper 118 in which the sheets 5 are received prior to feeding into the printing area; a first transport mechanism 180 that transports individual sheets 5 from the hopper 118 towards the printing area 114; and, a second transport mechanism 190 that transports the one-at-a-time fed sheet 5 beneath the print heads 140, located in the printing area 114.

Each of the transport mechanisms 180, 190 is similar in design and function, so that the discussion relating to transport mechanism 190 will suffice to explain the functioning of both transport mechanism 180 and 190 to a person of skill in the art. A conveyer belt 120 is disposed so that sheets 5 being fed from the hopper 118 are further transported through the printer area 114. The conveyer belt 120 may be a plurality of belts, as shown, disposed between rollers 123 and 124 so as to have an upper aspect facing the printing heads 140 and a lower aspect, displaced vertically from the upper aspect and traveling in an opposite direction thereto. Alternatively, a single belt may be provided, having a width substantially equal to that of the plurality of belts.

The belts are configured so as to be able to admit air through at least a porous portion of the transverse width thereof, such as by way of perforations or holes, 135 or pores. A plenum chamber 147 may be disposed below a portion of the upper aspect of the conveyer belt 120 so as to apply a suction force to the under side of the conveyer belt 120 through a suction chamber 129. A blower or fan 149 is connected to the plenum chamber 147 and operated so as to exhaust air from the plenum chamber 147. The suction chamber 129 is connected to the plenum chamber 147 by an aperture 150 (shown in FIG. 7) so that air admitted through the holes 135 and which may be admitted between the individual belts of the conveyer belt 120 is admitted into the plenum chamber 147, and subsequently exhausted by the blower 149. The flow of air is shown by the dashed-outline arrows.

When a sheet 5 is disposed above the upper surface of the conveyer belt 120, the sheet 5 may cover the spaces between individual belts of the conveyer belt, and may cover a portion of a broad conveyer belt 120 to the extent of the dimensions of the sheet 5. As will be described, a pair of longitudinal baffles 81 and shown in FIG. 6 (sometimes called "dampers") is disposed beneath the upper surface of the conveyer belt so as to limit the flow of air from areas of the conveyer belt not covered by the width of the sheet 5. The transverse distance between the baffles 81 is adjusted be less than the transverse width of the sheet 5, and may be set to a distance approximately corresponding to the transverse width of the printed area. When the communication between the suction device 127 and the plenum 147 is in a region near the centerline of the apparatus, the baffles 81 restrict the air flow such that air is preferentially drawn from the region between the baffles when compared to regions nearer either side of the apparatus. Thus the air pressure differential between the ambient environment at the top surface of the sheet 5, and the bottom surface of the sheet 5 positioned between the baffles 81, presses the sheet 5 against the conveyer belt 120. Also, in this manner, the amount of air drawn from outside of the region between the two baffles 81 may be minimized, so as to reduce the air flow in the vicinity of the printing heads 140. This may reduce disturbances to the ink jet drop trajectories.

At least one of rollers 123 and 124 is rotated by a motor so as to cause the linear motion of the conveyer belt 120 in the direction shown by the arrows. The motor may be a stepping motor, or other rotary device as is known in the art, or the rollers may be coupled to a prime mover such as an electric motor (not shown) by gears or belts, or the like. The lower surface of the sheet 5, being pressed down onto the upper surface of the conveyer belt 120, is transported through the printing region 114. The printing unit 114 may include sets of ink-jet heads 140*a*, 140*b* disposed so as to be oriented with the ink-jet nozzles thereof extending in a line perpendicular to the direction of travel of the sheet 5, and further disposed above the position of the sheet 5 as it passes the heads 140 along the direction of travel through the printer 100. A suction chamber 129 is disposed facing a side of the sheet 5 that does not face the ink-jet heads 140, with a conveyer belt 120 disposed between the suction device 129 and the sheet 5.

Figure 5A:
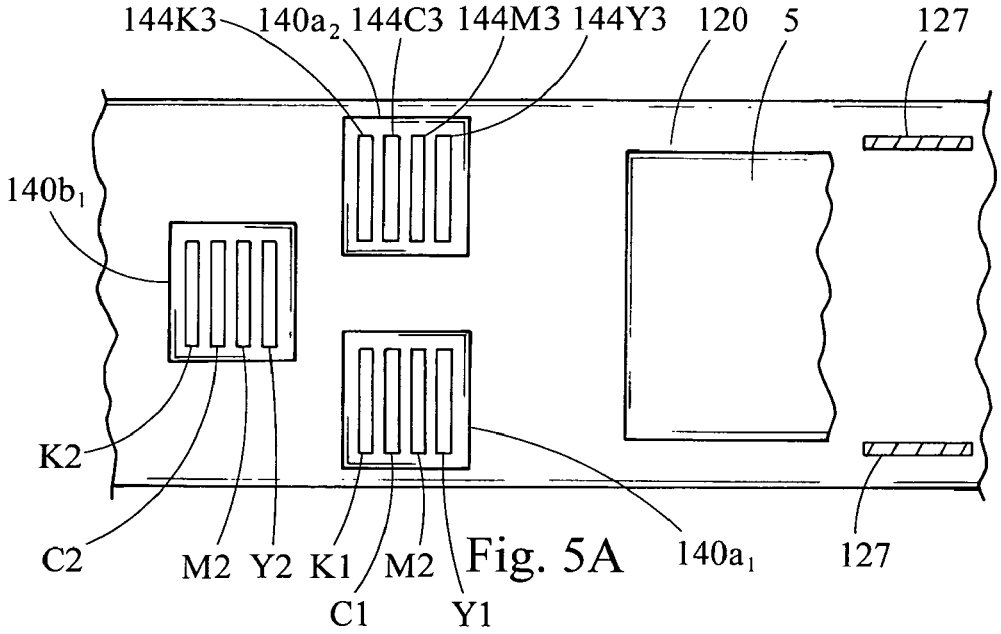
FIG. 5 illustrates: (a) an arrangement of ink jet print heads with respect to the sheet to be printed; (b) an arrangement where the area to be printed is oriented transverse to the direction of transport of the sheet; and, (c) an arrangement where the area to be printed is oriented longitudinal to the direction of transport of the sheet.

The printing unit 114 may have sets of ink jet heads 140 disposed above the sheet 5 and facing the surface of the sheet 5 that does not face either the conveyer belt 120 or the suction chamber 127. The ink jet heads 140 are directed such that ink is expelled downwardly so as to form dots with the desired density and color (dots per inch, DPI) on the surface of the sheet 5. As shown in FIG. 4, there are two sets of ink jet heads 140*a* and 140*b*, each set of heads having groups of nozzles 144Y, 144M, 144C and 144K (such as shown in FIG. 5*a*), corresponding to the yellow (Y), magenta (M), cyan (C) and black (K) ink. The nozzles 144 are disposed such that the ink-jet nozzles for each of the colors YMCK are parallel to each other, and the nozzles for each of the colors are separated by a distance along the direction of travel of the sheet 5. A controller 141 controls the action of the nozzles 144 so as to deposit the ink droplets in the proper locations to form the image desired.

The ink jet nozzles 144 are disposed a known distance from the opposing surface of the sheet 5, and the vertical position of the ink jet heads 140 may be adjusted to account for a thickness dimension of the sheet 5. Motorized jack screws 191*a, b, c*, and *d*, driven by motors 192*a, b, c*, and *d*, respectively, may be used to adjust the distance of the ink jet nozzles 144 from the top surface of the sheet 5 by raising and lowering the height of the platform 190, to which the ink jet heads 140 are mounted. In this manner, a desired distance between the ink jet nozzles 144 and the upper surface of the sheet 5 may be established, where different thicknesses of sheet 5 may be used from time-to-time.

Figure 5B:
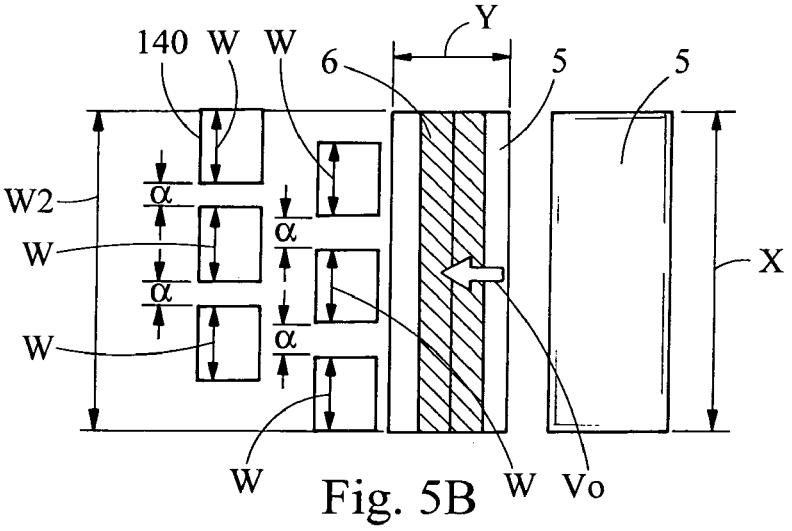
Figure 5C:
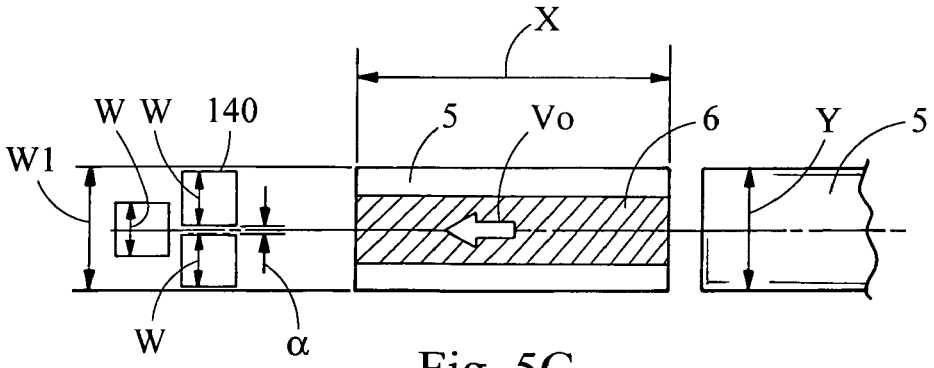

FIGS. 5*a-c* illustrate several differing arrangements of the printing heads 140 and orientations of the sheet 5. FIG. 5*a* is a partial plan view of the printing area 114, showing only the print heads 140, a simplified representation of the conveyer belt 120, the sheet 5, and, optionally, sheet guides 127. In this aspect, the width of the sheet 5 to be printed corresponds to three separate ink jet print heads 140*a*1, and 140*a*2, disposed in a line transverse to the direction of motion of the sheet 5, and ink jet print head 140*b*1, which is located along the centerline of the feed path, and further from the feeder than the ink jet heads 140*a*1 and 140*a*2. As ink jet heads 140*a*1 and 140*a*2 are disposed with a gap between them in the transverse direction, ink jet head 140*b*1 is disposed so that a sheet traversing the printing area 114 may be printed upon by at least one of the print heads 140, resulting in a continuous image in the width region encompassed by the print heads 140. The print controller 141 manages the printing process so as to result in the proper density and spacing of ink dots to print the desired image. Each of the print heads 140 is includes a row of nozzles for each of the YMCK print colors to be used.

FIGS. 5*b* and 5*c* contrast the arrangement of print heads which may be used depending on the orientation of the sheet 5 in passing through the print area 114.

FIG. 5*b* shows an arrangement of the sheet 5 where the transverse direction of the sheet 5 is aligned with the longitudinal direction X of the sheet direction of feeding (shown by the arrowhead). Each of the print heads 140 has a width W, and a spacing $\alpha$. Two groups of three print head 140 are disposed so that the total of six print heads spans the longitudinal dimension X of the sheet 5, or at least that portion of the longitudinal dimension on which printing is desired.

FIG. 5*c* illustrates an arrangement of print heads 140 corresponding to the situation where the sheet 5 is oriented such that the transverse direction Y is aligned with the direction of feeding (shown by the arrowhead). In this circumstance, the arrangement of three print heads 140, as shown also in FIG. 5*a* is sufficient to print the same or similar area 6 of the sheet 5.

Figure 6A:
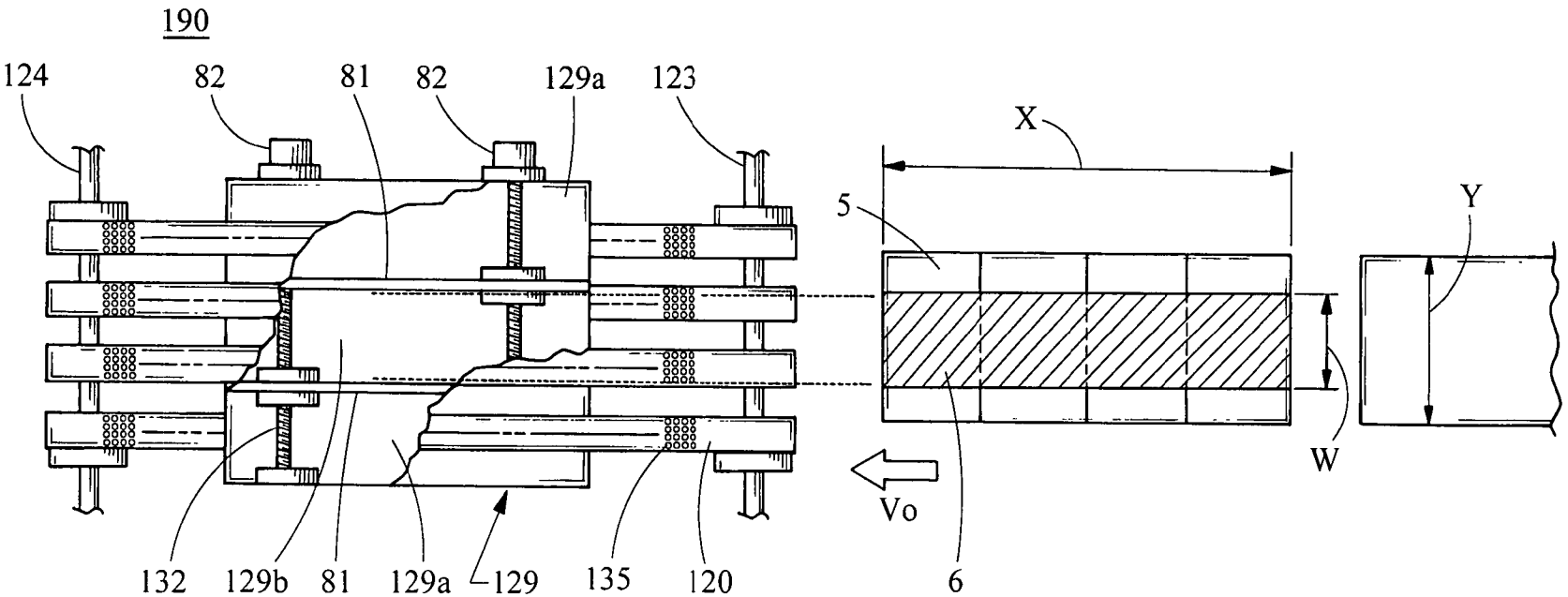
FIG. 6. illustrates details of the transport mechanism (a) for the arrangement of FIG. 5*c* and, (b) for the arrangement of FIG. 5*a*, respectively.

In the printing area 114 of the printer 100, the sheet 5 may be held tightly to the conveyer belt 120 by the suction provided by the suction chamber 129 and the plenum 147 so that the distance between an upper surface of sheet 5 and the ink jet nozzles 144 remains substantially constant. Undesirable air flows associated with the suction process may be mitigated, and the overall air flow volume required may be reduced by the use of baffles 81 in the suction box 129. FIGS. 6*a* and *b* illustrate the suction box and baffles 81 for the arrangements shown in FIGS. 5*b* and *c*, respectively.

The sheet 5 may be oriented with either the longitudinal dimension (long) X or the transverse direction (width) Y in the direction of motion with respect to the printing heads 114. Where the orientation is such that the longitudinal dimension is in the direction of motion, the width of the printer 100, and distance between the baffles 81 of the suction box 129 are less than that where the transverse dimension Y of the sheet 5 is oriented in the direction of motion. In addition, the area of the gap transverse to the direction of motion that arises between successive sheets 5 being fed by the feeder 112 is also reduced when the longitudinal dimension of the sheet 5 is oriented in the direction of feeding. In such a circumstance, the amount of air flowing in the vicinity of the print heads 114 may be reduced and the print quality may be improved.

Depending on the width of the print area 6, one or more print head assemblies 114 may be used to provide coverage of the entire width of the print area. Economic considerations may lead to the use of multiple print heads aligned in a direction transverse to the direction of motion of the sheet 5. Where multiple print heads 114 are used, a gap may be provided between adjacent print heads 114 in the width direction. A second row of print heads 114 may be provided so that the gap is filled in when the printing process is performed. In such a situation, the operation of the print heads may be coordinated so that the image being formed has density of ink that is consistent with the situation where a single wide ink head is used.

FIG. 6*a* illustrates a plan view of the configuration of the transport mechanism 190 for a situation where the sheet 5 is oriented with the longitudinal direction in the direction of feeding. The width W of the printable area 6 is shown. Dotted lines extending from the end of the sheet 5 towards the transport mechanism 190 show the alignment of the area 6 intended for printing with the baffles 81. The top of the suction chamber 129 may be formed of a solid material, perforated by holes, be open, or be open in the regions underneath the individual belts of the conveyer belt 120. Air passing through the holes 135 or other porosity in the belts 120, when the holes or porosity is disposed over the suction chamber 129 is exhausted through the plenum 147 creating a downward force to hold the sheet 5 to the belt 120 as the sheet 5 passes through the printing area 114. Baffles 81 include at least two vertical plates extending from underneath the portion of the belt 120 contacting the sheet 5 to a location near a bottom surface of the suction chamber 129, serving to restrict the flow of air from the exterior environment through regions 129*a*, while providing access for air from the exterior environment to enter region 129*b* and thence to the plenum 147. A port (shown in FIG. 7) may be provided to effect air flow between the suction box 129 and the plenum 147, while providing clearance for the belts and other portions of the printer.

Figure 6B:
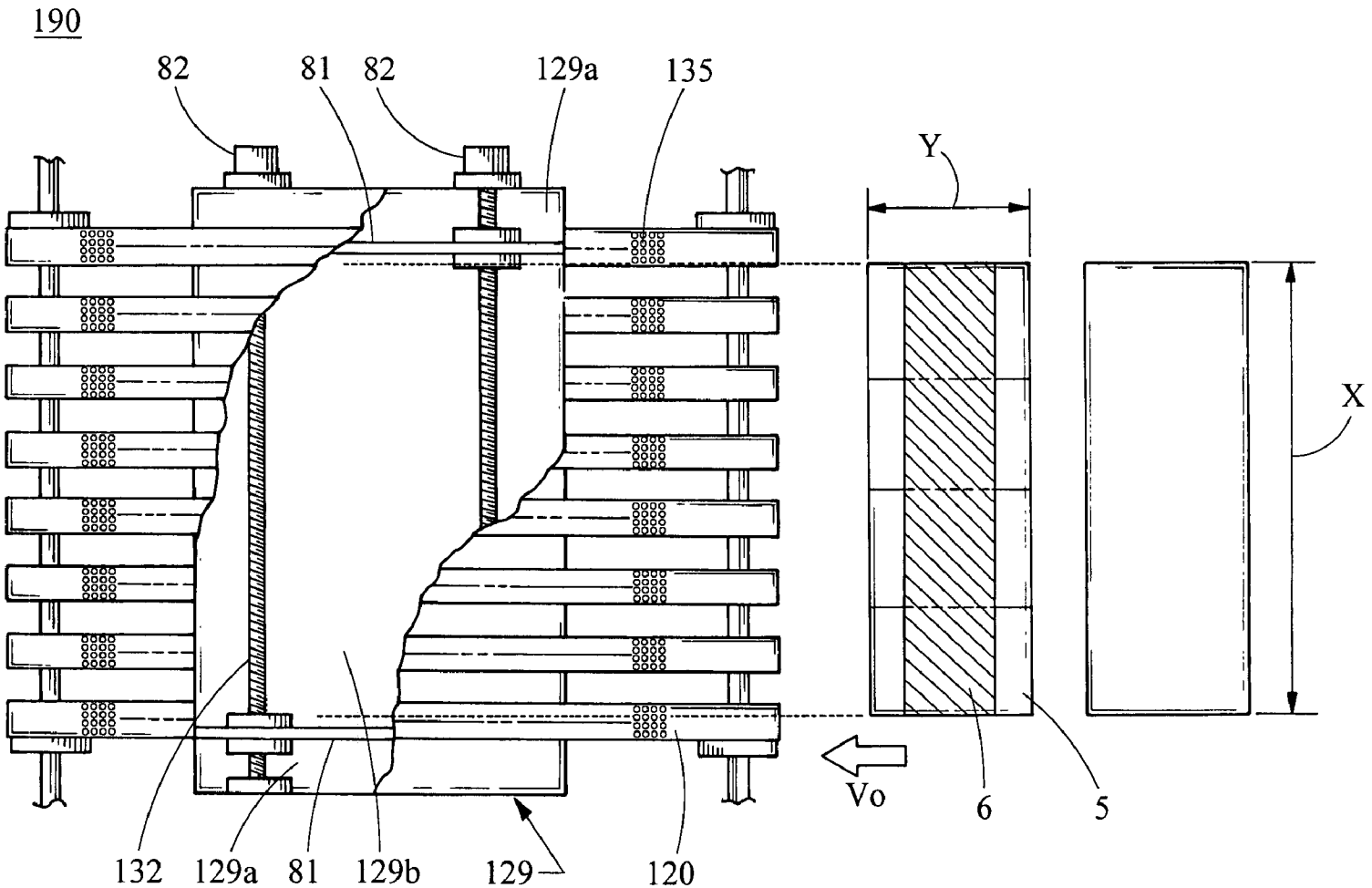

FIG. 6*b* illustrates a situation where the sheet 5 is disposed such that the transverse dimension Y thereof is oriented along the direction of feeding. The printing area 6 is of the same dimensions as in FIG. 6*a*. In this situation, as in the arrangement shown in FIG. 5*b*, the same printing area 6 corresponds to a larger dimensioning of the printer in the direction orthogonal to the direction of feeding when the direction of feeding of the sheet is in the transverse direction rather than the longitudinal direction. As in FIG. 6*a*, the maximum-width dimension of the printed area 6 is extended by dotted lines to show the correspondence with respect to the position of the baffles 81, where the baffles 81*l* and 81*r* are adjusted to provide a suction area under the entire printing area 6. In this example, the width of the printing area 6 is as wide as the maximum longitudinal dimension X of the sheet 5, rather than a portion of the transverse dimension Y. As such the amount of air which is accepted by the suction box 129 is greater. In addition, as the baffles 81 are moved nearer the edges of the sheet 5, air flow in this region may be greater than for the situation illustrated in FIG. 6*a*.

Figure 7:
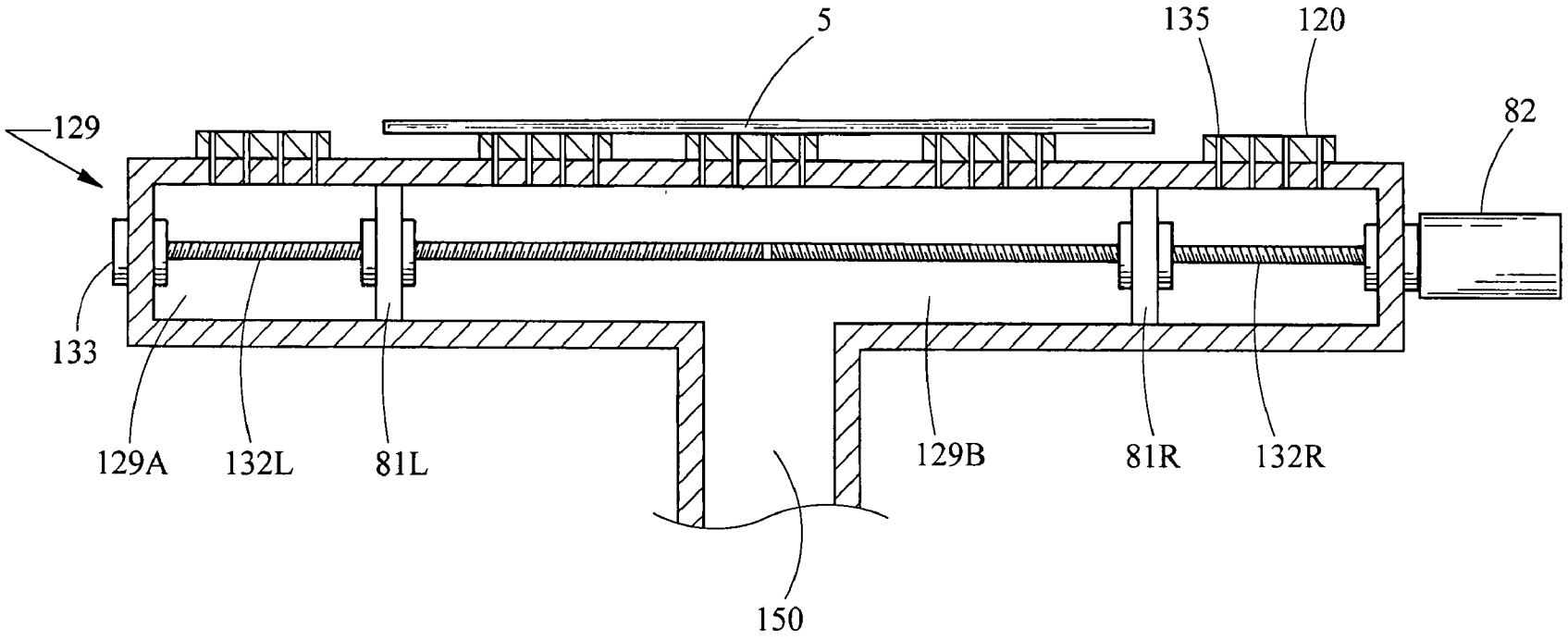
FIG. 7 is an elevation view of an aspect of the transport mechanism of FIG. 4 where the details of the baffles port connecting to the plenum are shown.

FIG. 7 shows baffles 81*l* and 81*r* threadedly engaged with screw shafts 132 extending transverse to the direction of sheet feeding. Each screw shaft 132 is has a left hand side 132*l* and a right hand side 132*r*, having opposite thread senses, but may be joined to form a single rotatable shaft supported by a bearing 133 at one end. The screw shaft 132 may be rotated by a motor 82, or manual means disposed at an opposite end of the shaft 132. Depending on the direction of rotation of the screw shaft 132, the transverse distance between the baffles 81*l* and 81*r* may be increased or decreased. As shown in FIG. 6*a*, the transverse spacing between the baffles 81 has been set such that each of the baffles 81 is collinear with the dotted line marking the outer extent of the printing area 6 in a transverse direction. Thus, when a sheet 5 is fed into the printing area, the suction force in area 129*b* is applied predominantly to the portion of the sheet 5 beneath the print heads 140 and corresponding to the area 6 on which a printing process is to be performed, holding that portion of the sheet tightly to the transport mechanism, and reducing the volume of air flow into the plenum 147. The dimensions of suction portion 129*b* may therefore be sized or adjusted to the width of the printed area 6.

Slots may be formed in the sheet 5 by a slotter 40 to permit the sheet 5 to be formed into a box 50. The slots may be formed either prior to of subsequent to feeding the sheets 5 through a printer 100, 200. Where the sheet 5 has been slotted prior to feeding through the printer, the sheet may be oriented so that, when the sheet 5 is fed in the direction of feeding, the slots are disposed further from the centerline of the printer so that the baffles 81 lie between the slots and the centerline of the printer. In this circumstance, the suction force in area 129*b* is applied to an unslotted surface of the sheet 5.

Figure 8:
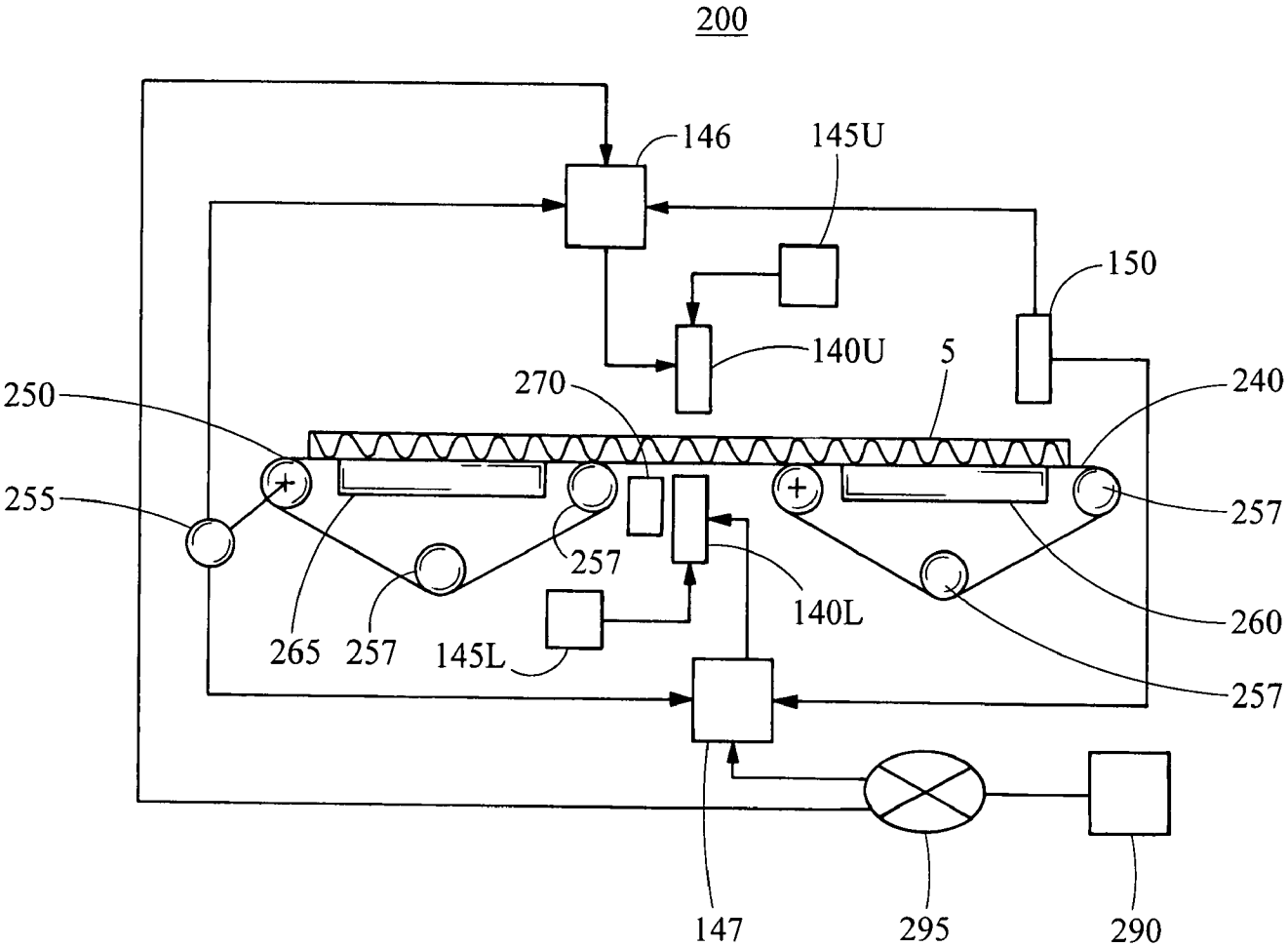
FIG. 8 illustrates an ink jet printer capable of printing both sides of a sheet.

In another example shown in FIG. 8, an ink-jet printer 200 may be configured to print a sheet 5 on both sides thereof in a single pass of the sheet 5 thought the printer 200. Many of the aspects of the printer 200 are similar to those of the printer 100, and only the significant differences are described. Further, the aspects related to feeding from the input sheet supply, the stacking of the output and subsequent operations, are not shown. FIG. 8 has two sets of print heads 140 U and 140 L, disposed so as to face opposite surfaces of the sheet 5. A single sheet 5 is shown in a position such that it is disposed between the print heads 140 U and 140 L. A first conveyer belt 240 and a second conveyer belt 250 are driven by stepping motors (not shown) driven by pulse generators 255, and there may be one or more idler wheels 257. A first suction chamber 260 and a second suction chamber 265 are disposed beneath the upper surface of the conveyer belts 240 and 250 such that the sheet 5 is pressed against the upper surface of the conveyer belts 240, 250 by the differential in air pressure existing between the ambient environment and the air pressure inside of the suction chambers 260, 265. The motion of the conveyer belts 240, 250 is such that the sheet 5 moves from right to left through the printer 200 when the stepper motors are energized.

The upper and lower print heads 140 U and 140 L are supplied with ink from ink reservoirs 145 U and 145 L, and the printing action of the upper and lower print heads 140 U and 140 L regulated by a first print controller 146 and a second print controller 147, respectively. Either or both sides of the sheet 5 may be printed in one pass through the printer 200, in accordance with the desired images to be printed on the sheet 5. A sensor 150, which may be an optical sensor, or the like, determines the time when the leading edge of the sheet 5 is at a predetermined distance from the print heads 140 U and 140 L, and actuates the ink-jet nozzles 144 accordingly to produce the images desired. A tachometer or shaft encoder may be connected to one or more of the idler or driving rollers 256, 257 to measure the speed of the conveyer belts 240, 250. The print controllers 146, 147 may use the sensor output of the detection of the leading edge of the sheet and the speed of advance of the sheet 5 to determine the time to commence printing. It should be appreciated that the relative registration of the colors, in forming an image, is related predominantly to the accuracy of relative positioning of the print heads 140, and a constant transport velocity v. This same type of control mechanism can be applied to any of the printers in the examples herein. After printing, the sheets may be stacked prior to further such as scoring and slotting, or these operations may be performed in a continuous sequential process.

As the bottom side of the sheet 5 (that is, the side of the sheet 5 that has been printed by print head 140L) is forced against the second conveyer belt 250 by the action of the suction chamber 265, the printed image on the bottom side of the sheet 5 may be smudged or blurred if the ink is not sufficiently dry by the time the printed area contacts the second conveyer belt 250. A dryer 270 may be positioned between the lower print head 140 L and the second conveyer belt 250 to accelerate the drying of the ink. The dryer may be of any type such as using hot air, microwave energy, infra-red or ultraviolet radiation or the like, so long as the sheet can be effectively dried so as to avoid smudging. In addition, print head 140L may be located closer to the end of the first conveyer belt 240 than to the second conveyer belt 250 so as to increase the ink drying time. The vertical position of the upper print head 140 U may be adjusted to achieve an optimal printing distance with respect to the facing surface of sheet 5, taking account of the thickness of sheet 5. The distance between the lower print head 140 L and the lower facing surface of the sheet 5 may not be adjusted, as the distance does not change with sheet thickness.

Thus, printer 200 may apply printing to both surfaces of a sheet 5 in a single operation, where differing images may be produced in accordance with the data and instructions furnished to the print controllers 146 and 147. The print controllers 146, 147 may receive data for controlling the printer and the images to be printed from a server 290 or other computer, and the server 290 or other computer may be either local or remotely located. In an aspect, the connection between the server 290 and the print controllers 146 and 147 may be over a local area network, a wide area network 290 such as the Internet, or by wireless communication techniques.

Figure 9:
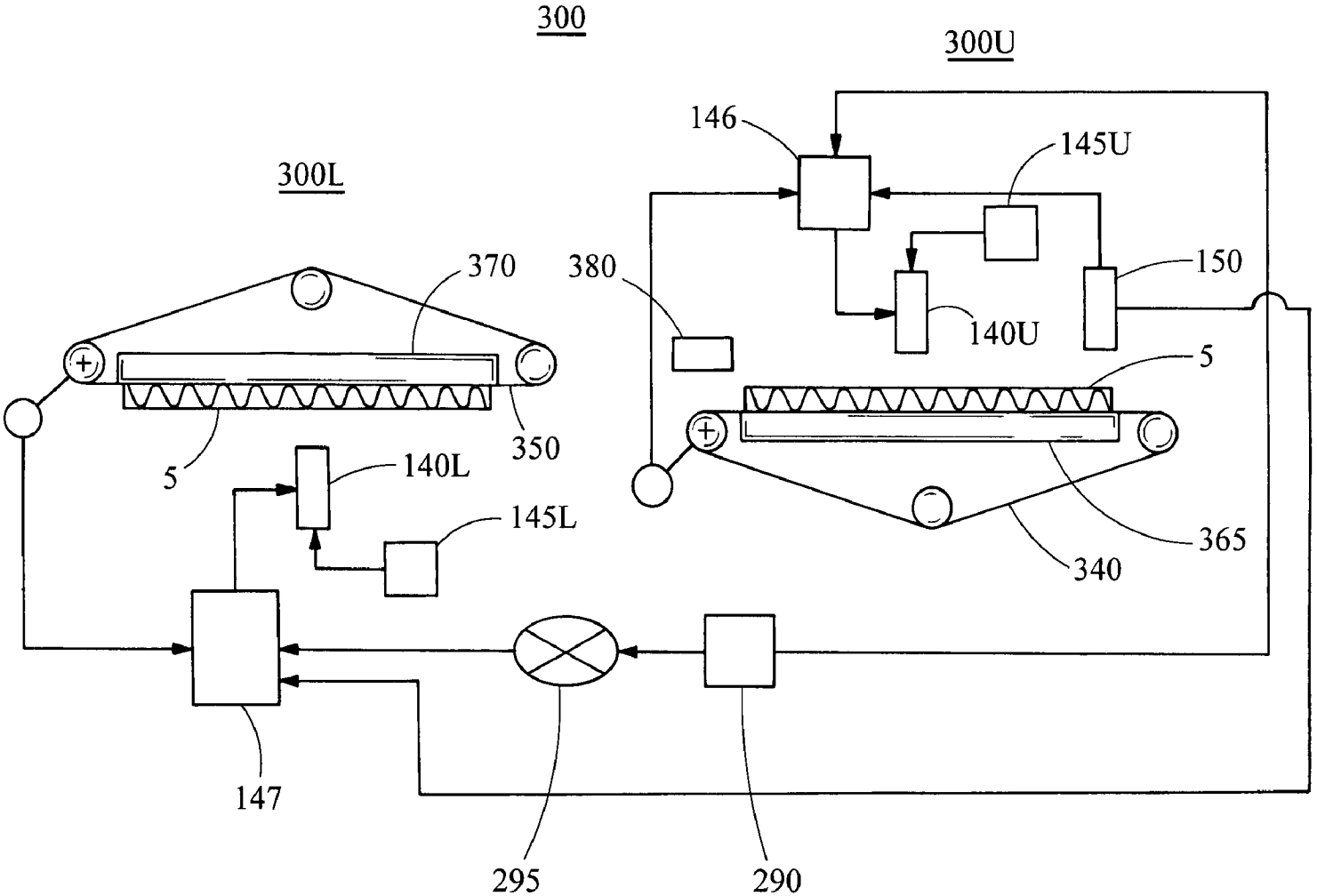
FIG. 9 illustrates another example of an ink jet printer capable of printing both sides of a sheet.

In still another example of a printer 300, shown in FIG. 9, two sequentially disposed printer units 300U and 300L may be used to print two surfaces of the sheet 5 in one operation. As in the previous examples, only one side may be printed if the print instructions do not require printing on both sides of the sheet 5. Only significant differences between the printer 300 and the previous examples are described. The printer 300 includes an upper surface printer 300 U and a lower surface printer 300L. The feeder, the stacker 116, slitter 30 and slotter 40 are not shown, but these aspects are discussed in previous examples. The printer 300 U is substantially the same as printer 100 and serves to print on an upper surface of sheet 5. In addition, a dryer 380 is disposed between the print head 140 U on the printer 300 U and the beginning of the second conveyer belt 350 of the printer 300 L. The dryer 380 is disposed such that the ink that was used to print the image on the upper surface of the sheet 5 is sufficiently dry that it is not smudged or blurred by contact with the second conveyer belt 350, where the sheet is held to the conveyer belt 350 by the differential in air pressure between the ambient environment and the suction box 370 associated with the second printer 300L. Print heads 140 L, are disposed below the sheet 5 in the second printer so that the side that was not printed in the first printer 300 U is now printed in the second printer 300L. The order of printers 300U and 300L is not significant, however the first printed side should be sufficiently dry when it contacts the conveyer belt of the second printer so that blurring is not experienced.

In each of the printers 300 U and 300L, the sheet 5 is disposed between the print head 140 and a surface of the conveyer belt 340, 350. Consequently, each of the print heads may be capable of adjustment in the vertical direction so as to accommodate sheets 5 of varying thickness, from print-job-to-print-job. The distance adjustment may be performed manually, or by a mechanism under the control of the print controllers.

Although only a few exemplary embodiments have been described in detail above, those skilled in the art will readily appreciate that many modifications are possible in the exemplary embodiments without materially departing from the novel teachings and advantages of the invention. Accordingly, all such modifications are intended to be included within the scope of this invention as defined in the following claims.

What is claimed is:

1. A printer for printing on a surface of a slotted corrugated sheet for forming into a box, comprising:
- a conveyer belt having apertures extending between a first surface and a second surface thereof;
- a suction unit for sucking the slotted corrugated sheet to be printed toward the first surface of the conveyor belt;
- a pair of baffle plates disposed in the suction unit in parallel to a direction of motion of the conveyer belt, the pair of baffle plates being movable in a direction transverse to the direction of motion of the conveyer belt so that a spacing distance between the pair of baffle plates is adjustable; and
- a plurality of ink jet nozzles disposed transverse to a direction of motion of the conveyer belt, the ink jet nozzles being spaced apart from the surface of the corrugated sheet to be printed;
- wherein the corrugated sheet has slots extending in a direction transverse to the direction of motion of the conveyer belt at the edges thereof; and, the pair of baffle plates are moved so as to define a printing area on a non-slotted portion of the corrugated sheet therebetween, so that the slots in the corrugated sheet are disposed outside of a suction area formed between the baffle plates.

2. A method of printing on a surface of a slotted corrugated sheet for forming a box, the method comprising:
- providing a conveyer belt having apertures extending between a first surface and a second surface thereof;
- disposing a suction unit for sucking the slotted corrugated sheet to be printed toward the first surface of the conveyor belt;
- providing a pair of baffle plates disposed in the suction unit in parallel to a direction of motion of the conveyer belt, the pair of baffle plates being movable in a direction transverse to the direction of motion of the conveyer belt so that a spacing distance between the pair of baffle plates is adjustable; and
- providing an ink jet print head disposed such that the ink jet nozzles are in a line perpendicular to the direction of motion of the conveyer belt;
- disposing the ink jet print head facing the first surface of the conveyer belt;
- positioning the corrugated sheet on the first surface of the conveyor belt such that a maximum dimension of the sheet is in the direction of motion of the conveyor belt;
- controlling the ink jet print head to deposit ink to form an image on the corrugated sheet in accordance with image data received by a controller; and,
- adjusting the pair of baffles provided in the suction box so that a suction area between the baffle plates is formed approximately below the area on which an image is printed,
- wherein the corrugated sheet has slots extending in a direction transverse to the motion of the conveyer belt at the edges thereof, and the pair of baffle plates are moved so as to define a printing area on a non-slotted portion of the corrugated sheet therebetween, and the slots in the corrugated sheet are disposed outside of a suction area formed between the baffle plates.

3. A printer for printing on a surface of a slotted corrugated sheet for forming into a box, comprising:
- a conveyer belt having apertures extending between a first surface and a second surface thereof;
- a suction unit for sucking the corrugated sheet toward the first surface of the conveyor belt;
- a pair of baffle plates having an adjustable spacing, disposed in the suction unit beneath a portion of the conveyer belt;
- a plurality of ink jet nozzles disposed transverse to a direction of motion of the conveyer belt, the ink jet nozzles being spaced apart from the conveyer belt such that the slotted corrugated sheet may pass therebetween;
- wherein the spacing of the baffle plates is adjusted such that the slots of the corrugated sheet are not disposed above the apertures of the conveyer belt forming a sucking area of the suction unit.

4. A method of printing on a surface of a corrugated sheet having slotted portions, the method comprising:
- providing a conveyer belt having apertures extending between a first surface and a second surface thereof;
- providing a suction unit for sucking the corrugated sheet toward the first surface of the conveyor belt; the suction unit further comprising
  - a pair of baffle plates disposed parallel to a direction of motion of the conveyer belt, the pair of baffle plates being movable in a direction transverse to the direction of motion of the conveyer belt so that a spacing distance between the pair of baffle plates is adjustable;
- providing an ink jet print head disposed such that the ink jet nozzles are in a line perpendicular to the direction of motion of the conveyer belt, the ink jet nozzles facing the first surface of the conveyer belt;
- positioning the corrugated sheet on the first surface of the conveyor belt such that a printing area is within an unslotted portion of the corrugated sheet;
- adjusting the spacing of the pair of baffle plates of the suction unit so that suction is applied to the unslotted portion of the corrugated sheet; and
- controlling the ink jet print head to deposit ink to form an image on the slotted corrugated sheet.

* * * * *

UNITED STATES PATENT AND TRADEMARK OFFICE

CERTIFICATE OF CORRECTION

PATENT NO. : 8,353,591 B2
APPLICATION NO. : 11/409551
DATED : January 15, 2013
INVENTOR(S) : Hideyuki Isowa et al.

It is certified that error appears in the above-identified patent and that said Letters Patent is hereby corrected as shown below:

In the Claims

In column 11, claim 1, line 38, after "surface of the" replace "conveyor" with --conveyer--.

In column 11, claim 2, lines 59-60, after "the first surface of the" replace "conveyor" with --conveyer--.

In column 12, claim 2, line 10, before "belt such that a" replace "conveyor" with --conveyer--.

In column 12, claim 2, line 11, after "of motion of the" replace "conveyor" with --conveyer--.

In column 12, claim 3, line 29, after "first surface of the" replace "conveyor" with --conveyer--.

In column 12, claim 4, line 45, after "first surface of the" replace "conveyor" with --conveyer--.

In column 12, claim 4, line 46, immediately after "unit further comprising" insert --:--.

In column 12, claim 4, line 56, before "belt such that a printing" replace "conveyor" with --conveyer--.

Signed and Sealed this
Eleventh Day of June, 2013

Teresa Stanek Rea

Teresa Stanek Rea
*Acting Director of the United States Patent and Trademark Office*